United States Patent [19]

Ramamoorthy et al.

[11] Patent Number: 4,784,752

[45] Date of Patent: Nov. 15, 1988

[54] METHOD FOR SUPPRESSING THE POISONING EFFECTS OF CONTAMINANT METALS ON CRACKING CATALYSTS IN FLUID CATALYTIC CRACKING

[75] Inventors: Periaswamy Ramamoorthy, El Sobrante; Ashok S. Krishna, Concord, both of Calif.

[73] Assignee: Chevron Research Company, San Francisco, Calif.

[21] Appl. No.: 47,084

[22] Filed: May 5, 1987

[51] Int. Cl.[4] ..... B01J 21/16

[52] U.S. Cl. ..... 208/251 R; 208/120; 208/48 AA; 208/251 R; 208/113; 208/52 CT; 208/127; 502/521; 502/84; 436/139

[58] Field of Search ..... 208/120, 52 CT, 48 AA, 208/251 R, 113, 127; 502/521; 436/139

[56] References Cited

U.S. PATENT DOCUMENTS

| | | | |
|---|---|---|---|
| 3,669,627 | 6/1972 | Mills | 436/139 |
| 3,977,963 | 8/1976 | Readal et al. | 208/48 AA |
| 4,036,740 | 7/1977 | Readal et al. | 502/521 |
| 4,083,807 | 4/1978 | McKinney et al. | 502/521 |
| 4,135,881 | 1/1979 | Baky et al. | 436/139 |
| 4,178,267 | 12/1979 | McKay | 502/521 |
| 4,193,891 | 3/1980 | McKay | 208/52 CT |
| 4,198,317 | 4/1980 | Bertus et al. | 208/52 CT |
| 4,207,204 | 6/1980 | McKay | 208/52 CT |
| 4,238,362 | 12/1980 | Bertus et al. | 208/52 CT |
| 4,238,451 | 12/1980 | Ciais et al. | 436/139 |
| 4,248,599 | 2/1981 | Mommessin et al. | 436/139 |
| 4,257,876 | 3/1981 | McKay | 208/52 CT |
| 4,280,895 | 7/1981 | Stuntz et al. | 502/521 |
| 4,280,896 | 7/1981 | Bearden et al. | 502/521 |
| 4,321,129 | 3/1982 | Bertus et al. | 208/52 CT |
| 4,466,884 | 8/1984 | Occelli et al. | 208/52 CT |
| 4,513,093 | 4/1985 | Beck et al. | 502/521 |

*Primary Examiner*—H. M. Sneed
*Assistant Examiner*—Helane Myers
*Attorney, Agent, or Firm*—S. R. La Paglia; T. G. DeJonghe; Q. T. Dickinson

[57] ABSTRACT

Poisoning of a cracking catalyst by contaminant metals such as nickel, vanadium and iron during fluid catalytic cracking of hydrocarbon charge stock containing the contaminant metals is suppressed by depositing minor amounts of a bismuth-containing passivating agent on the catalyst, desirably, a weight ratio of bismuth to nickel equivalents (nickel+0.2 vanadium+0.1 iron) of about 0.01:1 to about 1:1. The passivating agent can also comprise mixtures of compounds of bismuth and antimony, bismuth and tin.

28 Claims, No Drawings

METHOD FOR SUPPRESSING THE POISONING EFFECTS OF CONTAMINANT METALS ON CRACKING CATALYSTS IN FLUID CATALYTIC CRACKING

FIELD OF THE INVENTION

The invention relates generally to catalytic cracking of hydrocarbons and in particular it relates to the suppression or mitigation of the poisoning effects of contaminant metals such as nickel, vanadium, and iron on cracking catalysts by deposition of controlled amounts of a passivating agent. The passivating agent preferably consists of bismuth or bismuth compounds alone, or bismuth in combination with antimony, tin or both. Desirably, the passivating agent containing bismuth is introduced into the fluid catalytic cracking unit at a rate that maintains a weight ratio of bismuth to nickel equivalents (nickel+0.2 vanadium+0.1 iron) ratio of about 0.01:1 to about 1:1 over the course of the cracking reaction.

BACKGROUND OF THE INVENTION

Feedstocks containing higher molecular weight hydrocarbons are cracked by contacting the feedstocks under elevated temperatures with a cracking catalyst whereby light and middle distillates are produced. Deterioration occurs in the cracking catalyst which can be partially attributable to the deposition on the catalyst of metals introduced into the cracking zone as contaminants in the feedstock. The deposition of these metals, such as nickel and vanadium, results in a decrease in the overall conversion of the feed as well as a decrease in the relative amount converted to gasoline. Another effect of these contaminant metals on the cracking catalyst is to catalyze dehydrogenation reactions, leading to an increased production of coke and hydrogen during the cracking process.

These catalyst poisoning metals are generally in organometallic form, such as in a porphyrin. During the catalytic cracking process, these metals deposit in a relatively non-volatile form on the cracking catalyst. These metal contaminants are generally specified as parts per million (ppm) nickel equivalents, defined as the sum of the nickel content in ppm plus one-fifth the vanadium content in ppm, plus one-tenth the iron content in ppm (nickel+0.2 vanadium+0.1 iron). As a general rule it is necessary to replace unprotected, contaminated catalyst with fresh catalyst at a rate sufficient to limit the amount of poisoning metals on the catalyst in order to prevent an excessive deterioration in catalyst performance.

U.S. Pat. No. 3,977,963 describes the passivation of a metal-poisoned cracking catalyst with bismuth; the use of an excess quantity of bismuth is illustrated in the example in which the bismuth to nickel equivalents weight ratio is 1.97:1.

SUMMARY OF THE INVENTION

The present invention comprises a process for the conversion of hydrocarbon oil feed which comprises contacting a hydrocarbon feed containing metal contaminants including nickel, vanadium and iron with a cracking catalyst in a fluid catalytic cracking system, the improvement comprising (a) analyzing the hydrocarbon feed for nickel equivalents (defined as nickel+0.2 vanadium+0.1 iron) and determining the quantity of nickel equivalents in said hydrocarbon feed and (b) introducing a composition for mitigating or suppressing the contaminants-caused poisoning of the catalyst into said catalytic cracking system, said composition comprising a bismuth compound or mixtures of bismuth compounds in a weight ratio of introduced bismuth to nickel equivalents of between about 0.01:1 to about 1:1.

The process of this invention has a significant advantage over conventional catalytic cracking processes by providing an economically attractive method to include higher metal contaminant content feeds to the catalytic cracking process. Because of the loss of selectivity to high value products (loss of conversion and reduced gasoline yield) with the increase in metals contamination on conventional cracking catalysts, most refiners attempt to maintain a low metals level on the cracking catalyst. A less satisfactory and less economical method of controlling metals contamination, in addition to those previously discussed, is to increase the catalyst makeup rate to a level higher than that required to maintain overall catalyst activity and to satisfy catalyst losses in the cracking system.

Among other factors, the present invention is based on our discovery that a surprising improvement in the suppression of catalyst poisoning can be accomplished with a proportionally smaller amount of bismuth than suggested for use in the prior art. In fact, we have found that, in some instances, greater amounts of bismuth are less effective than the preferred ranges used according to the present invention, and may sometimes actually provide negative effects. Furthermore, excessive amounts of bismuth can often result in poor deposition efficiencies on catalyst and high levels of bismuth can end up in the cracked cycle oil products. Such high levels of bismuth in the cycle oil products can have deleterious effects on downstream hydroprocessing catalysts when the cycle oils are processed further. Therefore, a key aspect of the present invention is to control the weight ratio of bismuth to nickel equivalents in the feed to within specified ranges.

DETAILED DESCRIPTION OF THE INVENTION

As in most fluid catalytic cracking systems, the process of the present invention is carried out in a system which includes a cracking zone and a separate catalyst regeneration zone. The regeneration zone is integral with the cracking zone, and the catalyst is circulated through it for burning off deposited carbon and regenerating the catalyst.

In a fluid catalytic cracking operation which continues over a relatively long period of time, catalyst is continuously or periodically removed from the system and replaced with an equal quantity of fresh make-up catalyst at a sufficient rate, as determined by analytical or empirical evidence obtained from the cracking operation, to maintain suitable overall catalyst activity. Without catalyst replacement in a continuing operation, catalyst exhaustion is inevitable. The life of the catalyst can be beneficially extended, however, by the use of passivators which reduce or retard the detrimental effects of the metals contaminants. Using a passivating agent which in the present invention preferably comprises bismuth or its compounds, the fluid cracking process can operate continuously for long periods of time notwithstanding a high metals content in the hydrocarbon feed. This continuous cracking procedure can be carried out with a relatively stabilized ratio of bismuth to nickel equivalents deposited on the cracking catalyst within the specified range, this ratio being determined by the ratio of these metals introduced into the cracking system. We have found that the specified range is critical for achieving the desirable benefits of passivation: if the bismuth to nickel ratio in the feed is too low, insufficient passivation is achieved; if too high, the results may sometimes be less desirable than without the use of any passivator. Thus, the present invention involves a hydrocarbon catalytic cracking process in which the level of contaminant metals in the feed are specifically and regularly measured, and the rate of passivator addition carefully controlled to achieve passivator to contaminant metal weight ratios on catalyst within a specified range.

A particular advantage of our process is that it enables us to conduct a fluid cracking operation on a hydrocarbon feed and maintain a high activity of the cracking catalyst to the desired, more volatile products, notwithstanding the fact that the catalyst has an exceptionally high content of deposited nickel equivalents; a content which can be as high as 5,000 to 10,000 ppm. As a result of this substantial improvement in tolerance of the catalyst to metals poisoning, the fluid catalytic cracking operation can be carried out with a significant reduction in the rate of catalyst replacement over the rate which would otherwise be required for activity maintenance of a non-protected catalyst. This reduction in catalyst requirements, therefore, results in a substantial saving in catalyst costs, and a concomitant savings in overall process costs.

Our process is especially suitable for use with crude petroleum feedstocks having a high nickel equivalents content. However, other heavy hydrocarbon feed materials containing high levels of metal poisons, such as 50 to 100 ppm nickel equivalents and higher, can also be economically cracked by our process. This permits the economical upgrading of currently unattractive low quality, high-metals, heavy hydrocarbon fractions such as residuum in a fluid cracking process using a zeolitic cracking catalyst—an undertaking that is not ordinarily possible with an unproteted catalyst.

In a preferred embodiment, bismuth is added to the system in a rate controlled manner by adding bismuth itself or a bismuth-containing compound to the cracking reactor, either in the feed stream itself or in a separately-introduced stream to the cracking reactor. It may also be introduced by injecting the bismuth or bismuth-containing compound directly into the regenerator. For convenience in handling, these compounds can be dissolved in a suitable quantity of a hydrocarbon solvent such a benzene, toluene, alcohols, glycols, mild organic acids such as acetic acid, a hydrocarbon fraction that is recovered from the cracking operation, or a colloidal suspension of the metal or metal compound in any of these solvents. The bismuth solution can then be more easily metered into the system at the desired rate. Alternatively, the bismuth compound can be impregnated onto the replacement catalyst by a conventional, suitable impregnation technique prior to the catalyst's use. The passivating composition may also be deposited on separate, non-zeolite containing particles or used catalyst fines containing the passivating composition may also be used. In this instance, the amount of bismuth that is deposited on the catalyst is correlated both with the catalyst replacement rate and with the rate that metal contaminants are fed to the reactor. It is this controlled rate of addition which is key to the unexpectedly successful nature of the invention.

The amount of bismuth that is used to passivate the nickel equivalents on the catalyst is preferably determined by analyzing the feed stream for nickel, vanadium, and iron. The bismuth compound is then metered into the cracking unit or into the regenerator at a rate which is within the range of about 0.01:1 to about 1:1 parts by weight of bismuth per part of nickel equivalents in the feed stream. However, we have found that superior results are achieved by feeding the bismuth compound at a rate which is within the range of about 0.1:1 to about 1:1 parts of bismuth per part of nickel equivalent in the hydrocarbon feed. An alternative, but less preferred method of addition control comprises measuring the nickel equivalents on the catalyst itself and then adjusting the bismuth on the catalyst to be within the preferred ratio.

Any bismuth compound, containing organic groups, inorganic groups or both, which suppresses the catalyst deactivating effect of the poisoning metals can be used effectively. When the bismuth compound is introduced with the feed stream into the catalytic reactor, an oil-soluble or process hydrocarbon-soluble organic compound of bismuth is generally preferred. The preferred organic groups include alkyl groups having from one to twelve carbon atoms, preferably one to six carbon atoms; aromatic groups having from six to eight carbon atoms, preferably phenyl; and organic groups containing oxygen, sulfur, nitrogen, phosphorus or the like.

Suitable compounds of bismuth include bismuth metal, bismuth oxide, and compounds convertible to bismuth oxide under the conditions commonly employed in the fluid catalytic cracking process. Other suitable compounds include bismuth chlorides, nitrates, hydroxides, octoates, phosphates, sulfates, sulfides, selenides, molybdates, zirconates, borates, naphthenates, oxalates, titanates, triethyl, triphenyl and trivinyl bismuth. However, water-soluble compounds of bismuth and even insoluble bismuth metal or bismuth compounds such as the hydroxy carbonates or subcarbonate can also be used. The halides are also useful but are less preferred.

When bismuth is first introduced to a bismuth-free catalyst containing deposited nickel equivalents, whether in the start-up of a cracking operation or in the middle of an ongoing cracking operation, the ratio of bismuth to nickel equivalents on the catalyst will be less than specified above until the bismuth level on the catalyst has time to build up. Therefore, the catalytic cracking operation of this invention can be initiated by initially introducing a relatively high level of bismuth to the cracking system. This relatively high level of bismuth addition can be continued until the bismuth build-up on the catalyst has reached a desirable level, preferably a level of at least about 0.01 part by weight of bismuth, and more preferably a level of at least about 0.1 part by weight of bismuth per part of nickel equivalents.

Once the level of the bismuth on the cracking catalyst has built up to the desired level, the amount of bismuth fed to the catalyst system can be reduced to maintain the desired ratio of bismuth to nickel equivalents on the cracking catalyst. In steady state operation, the ratio of added bismuth to nickel equivalents in the feed will be substantially the same as the ratio of bismuth and nickel equivalents deposited on the catalyst even with regular replacement of the catalyst with fresh catalyst. If variations in the amount of nickel equivalents present in the feed stream occur with time, these changes can be accommodated by appropriate variations in the amount of bismuth added to the cracking system.

The maintenance of the appropriate passivator level is essential to the invention and requires that the metals composition of the feed stream be monitored on a regular basis. The bismuth compound can then be conveniently metered into the hydrocarbon feed stream and fed into the catalytic reactor with this hydrocarbon stream. Since the bismuth compound is used in such small quantities, it is convenient to utilize a diluted solution of the bismuth compound in a suitable, preferably organic solvent. However, as discussed above the bismuth compound can also be injected into the cracking zone with the steam or as a separate stream, or it can also be injected into the catalyst regeneration zone. Regardless of where the bismuth is introduced into the cracking system, however, it will deposit onto the cracking catalyst and achieve the passivating effects of this invention.

In a preferred method of introducing the passivating agent by the controlled rate addition, a sample of the combined, fresh feed to the catalytic cracking unit is first analyzed for nickel, vanadium and iron content. For this purpose, any of the well-known methods of analyzing the metals content of hydrocarbon oils can be used, such as standard Atomic Spectroscopy techniques. In addition, the density of the fresh feed is measured. The critical addition rate of the passivator-containing chemical is then calculated using the following formula:

Addition Rate of Passivator-containing Chemical, gallons/day = [(nickel + 0.2 vanadium + 0.1 iron) in the fresh feed, ppm] × (density of fresh feed, lbs/bbl)($10^{-4}$) × (FACTOR) × (fresh feed rate to the unit, bbls/day)/(wt % passivator in chemical) × (density of passivator-containing chemical, lbs/gal)

where FACTOR = 0.01 to 1.0, preferably, 0.1 to 1.0 according to the teaching of the present invention.

To achieve the benefits of the present invention, the feed to the catalytic cracking unit is preferably monitored on a frequent basis, say daily, the feed sample is analyzed for its nickel, vanadium and iron content and density, the rate of passivator addition in gals/day is determined according to the above formula, and the passivator-containing chemical metered in accordingly. The rate of addition of the passivator-containing chemical should then be altered on a frequent basis, say daily, to achieve the desired weight ratio of passivator to feed nickel equivalents.

To further ensure that the present invention is being applied correctly, samples of equilibrium catalyst should preferably be withdrawn from the catalytic cracking unit periodically, say weekly, and analyzed for metals content. Well-known methods such as X-Ray Fluorescence (XRF) can be used to measure the amounts of nickel, vanadium, iron and the passivator, say bismuth, on the catalyst. Proper addition of the passivator in the feed, in the weight ratio range of 0.01 to 1.0 passivator to nickel equivalents, should result in passivator to nickel equivalents weight ratio on catalyst in the range of 0.01 to 1.0 as well, at steady state.

After the bismuth compound is introduced into the catalytic cracking system, whether in the cracking zone or in the regeneration zone, the bismuth deposits onto the catalyst generally by decomposition of the bismuth compound. Since all of the catalyst is treated with an oxygen-containing gas, usually air, in the regeneration zone at an elevated temperature, all of the bismuth which does not react with the catalyst components is believed to be converted on the catalyst surface to bismuth oxide.

The catalysts most effectively finding use in the cracking processes of this invention are preferably zeolitic-containing catalysts wherein the concentration of the zeolite is in the range of 6 to 40 weight percent of the catalyst composite, and which also may have a tendency to be deactivated by the deposition thereon of metal contaminants. Appropriate cracking catalyst compositions include those which comprise a crystalline aluminosilicate dispersed in a refractory metal oxide matrix such as disclosed in U.S. Letters Pat. Nos. 3,140,249 and 3,140,253 to C. J. Plank and E. J. Rosinski. Suitable matrix materials comprise inorganic oxides such as amorphous and semi-crystalline silica-aluminas, silica-magnesias, silica-alumina-magnesia, alumina, titania, zirconia, and mixtures thereof.

The preferred zeolites or molecular sieves having cracking activity and suitable in the preparation of the catalysts of this invention are crystalline, three-dimensional, stable structures containing a large number of uniform openings or cavities interconnected by smaller, relatively uniform holes or channels. The formula for the zeolites can be represented as follows:

$$xM_{2/n}O:Al_2O_3:1.5\text{-}6.5\ SiO_2:yH_2O$$

where M is a metal cation and n its valence; x varies from 0 to 1; and y is a function of the degree of dehydration and varies from 0 to 9. M is preferably a rare earth metal cation such as lanthanum, cerium, praseodymium, neodynium or mixtures thereof.

Preferred zeolites include both natural and synthetic zeolites. Natural-occurring zeolites include gmelinite, chabazite, dachiardite, clinoptilolite, faujasite, heulandite, analcite, levynite, erionite, sodalite, cancrinite., nepheline lazurite, scolecite, natrolite, offretite, mesolite, mordenite, brewsterite, ferrierite, and the like. Suitable synthetic zeolites which can be employed include zeolites, X, Y, A, L, ZK-4, B, E, F, H, J, M, Q, T, W, Z, alpha and beta, ZSM-types and omega.

The term "zeolites" as used herein contemplates not only aluminosilicates but substances in which the aluminum is replaced by gallium, and substances in which the silicon is replaced by germanium.

The more preferred zeolites of the present invention include the synthetic faujasites of the types Y and X, or mixtures thereof. The silica to alumina ratio and the cell constant of the synthetic faujasites can be in the ranges of 3 to 50 and 24.0 to 25.0, respectively, thereby including the so-called "ultrastable zeolites", as described in U.S. Pat. No. 4,287,048.

Conventional methods can be employed to form the catalyst composite. For example, finely divided zeolite can be admixed with the finely divided matrix material, and the mixture spray dried to form the catalyst composite. Other suitable methods of dispersing the zeolite materials in the matrix materials are described in U.S. Pat. Nos. 3,271,418; 3,717,587; 3,657,154; and 3,676,330, whose descriptions are incorporated herein by reference.

In addition to the zeolitic-containing cracking catalyst compositions heretofore described, other materials useful in preparing the bismuth-containing catalysts of this invention also include the laminar 2:1 layer-lattice aluminosilicate materials described in U.S. Pat. No. 3,852,405. The preparation of such materials is described in the said patent, and the disclosure therein is incorporated in this application by reference. When employed in the preparation of the catalysts of this invention, such laminar 2:1 layer-lattice aluminosilicate materials are combined with a zeolitic composition.

As used herein, "fluid catalytic cracking system" or "catalytic cracking system" refers to the overall integrated reaction system, including the catalytic reactor unit, the regenerator unit and the various integral support systems and interconnections. In a preferred process, the cracking occurs in a vertical, elongated reactor tube generally referred to as the riser. As an alternative, a catalyst reactor bed may also follow the risk. The charge stock is preferably passed through a preheater, which heats the feed to a temperature of about 600° F. (316° C.), and the heated feed is then charged into the bottom of the riser, which ordinarily has a length-to-diameter ratio of about 20. Steam and the charge stock together with recirculating, regenerated catalyst are introduced into the bottom of the riser and quickly pass to the top and out of the riser. The catalyst quickly separates from the gases and passes to a bed of the catalyst in the regenerator unit where carbon is burned off with injected air. Means for catalyst removal and addition of make-up catalyst are provided in the regenerator unit. The temperature in the catalytic reactor is preferably between about 900° F. and about 1100° F., and the temperature in the regenerator between about 1050° F. and about 1450° F. A suitable reaction system is described and illustrated in U.S. Pat. No. 3,944,482, which is incorporated herein by reference.

In a preferred operation, a contact time (based on feed) of up to 15 seconds, and catalyst-to-oil weight ratios of about 4:1 to about 15:1 are employed. Steam can be introduced into the oil inlet line to the riser and/or introduced independently to the bottom of the riser so as to assist in carrying regenerated catalyst upwardly through the riser. Regenerated catalyst is introduced into the bottom of the riser at temperatures generally between about 1100° and 1350° F. (593° to 732° C.).

The riser system, at a preferred pressure in the range of about 5 to about 50 psig (0.35 to 3.50 kg/cm$^2$), is normally operated with catalyst and hydrocarbon feed flowing concurrently into and upwardly into the riser at about the same flow velocity, thereby avoiding any significant slippage of catalyst relative to hydrocarbon in the riser.

The riser temperature drops along the riser length due to heating and vaporization of the feed, by the slightly endothermic nature of the cracking reaction, and by heat loss to the atmosphere. As nearly all the cracking occurs within one or two seconds, it is necessary that feed vaporization occurs nearly instantaneously upon contact of feed and regenerated catalyst at the bottom of the riser. Therefore, at the riser inlet, the hot, regenerated catalyst and preheated feed, generally together with a mixing agent such as steam, nitrogen, methane, ethane or other light gas, are intimately admixed to achieve an equilibrium temperature nearly instantaneously.

The catalyst, containing metal contaminants and coke, is separated from the hydrocarbon product effluent, withdrawn from the reactor and passed to a regenerator. In the regenerator the catalyst is heated to a temperature in the range of about 800° to about 1600° F. (427° to 871° C.), preferably about 1160° to about 1350° F.(617° to 682° C.), for about three to thirty minutes in the presence of an oxygen-containing gas, ordinarily air. This burning step is conducted so as to reduce the concentration of the carbon on the catalyst, preferably to less than about 0.3 weight percent, by conversion of the carbon to carbon monoxide and/or carbon dioxide.

In accordance with another embodiment of this invention, there is also provided a novel passivating agent which comprises bismuth and antimony, or bismuth and tin, or bismuth, antimony and tin, either as the elemental metals, their compounds, or mixtures thereof. The weight ratio of bismuth to antimony, and bismuth to tin is selected so as to provide effective passivation of contaminant metals, which may even through appropriate monitoring, be greater than the sum of the passivation effects of each of the bismuth and antimony, or bismuth and tin individually. In general, the effective weight ratio of bismuth to antimony and bismuth to tin will be within the range of about 0.001:1 to about 1000:1, more preferably, 0.01:1 to 100:1 and most preferably in the range of 0.05:1 to 5:1.

The following examples are presented to illustrate objects and advantages of the invention. However, it is not intended that the invention should be limited to the specific embodiments presented therein:

EXAMPLES

Example I

In this example, the embodiment of the present invention that illustrates the controlled addition of the passivator to the catalytic cracking unit, in a certain predetermined proportion to the nickel equivalents in the fresh feed, is shown. For this hypothetical FCC unit charging between 20,000 to 25,000 B/D of feed, a bismuth-containing passivator is employed. The additive compound used contains 10% bismuth by weight, and the additive has a density of 7.5 lbs/gallon.

Table I illustrates how the feed rate and quality to the hypothetical FCC unit varies over a 30-day period. Note that the nickel, vanadium, and iron contents of the feed, as well as its density, can each vary independently. The nickel equivalents in the feed is then calculated using the formula (nickel+0.2 vanadium+0.1 iron), ppm. The rate of addition of bismuth-containing additive, in gallons/day, is calculated according to the formula:

[(nickel+0.2 vanadium+0.1 iron) in the fresh feed, ppm]×(density of fresh feed, lbs/bbl)($10^{-4}$)×(FACTOR)×(fresh feed rate to the unit, bbls/day) /(wt % bismuth in additive)×(density of bismuth-containing additive, lbs/gal).

The bismuth addition rates shown in Table I were calculated assuming FACTOR=0.5 in the above equation. Note that in order to correctly practice the teachings of the present invention, and achieve maximum passivation benefits, the feed is analyzed on a daily basis, and the bismuth addition rate adjusted to keep the weight ratio of bismuth to nickel equivalents in the feed constant as feed rate, density, and/or metals contents change.

TABLE I

| Day | Fresh Feed Rate, bbls/day | Fresh Feed Density, lbs/bbl | Metals in Fresh Feed, ppm Nickel | Vanadium | Iron | Nickel Equivalents in Fresh Feed, ppm | Passivator-Containing Additive Rate gal/day | Bismuth to Nickel Equivalents in Feed (wt/wt) |
|---|---|---|---|---|---|---|---|---|
| 1 | 20,000 | 315 | 5.6 | 0.3 | 2.0 | 5.86 | 24.6 | ↑ |
| ↓ | ↓ | ↓ | ↓ | ↓ | ↓ | ↓ | ↓ | ↑ |
| 5 | 20,000 | 318 | 7.9 | 2.2 | 2.0 | 8.54 | 36.2 | ↑ |
| ↓ | ↓ | ↓ | ↓ | ↓ | ↓ | ↓ | ↓ | ↑ |
| 8 | 25,000 | 320 | 8.8 | 3.4 | 5.0 | 9.98 | 53.22 | ↑ |
| ↓ | ↓ | ↓ | ↓ | ↓ | ↓ | ↓ | ↓ | ↑ |
| 19 | 22,000 | 314 | 4.2 | 0.7 | 2.0 | 4.54 | 20.91 | 0.5 |
| ↓ | ↓ | ↓ | ↓ | ↓ | ↓ | ↓ | ↓ | ↓ |
| 30 | 20,000 | 315 | 5.6 | 0.3 | 2.0 | 5.86 | 24.6 | ↓ |

Additional Examples

A series of cracking runs was carried out to determine the effect of bismuth in catalytic cracking using a fixed bed of a zeolite catalyst heavily poisoned with nickel or vanadium. The cracking was carried out on a virgin gas oil having the properties as shown in Table II.

TABLE II

| | |
|---|---|
| Gravity, API | 27.9 |
| Sulfur, wt % | 0.59 |
| Nitrogen, wt % | 0.09 |
| Carbon residue, Rams D525, wt % | 0.33 |
| Vacuum distillation, ASTM D1160, °F. | |
| 10% at 760 mm | 595 |
| 30% | 685 |
| 50% | 765 |
| 70% | 845 |
| 90% | 934 |

The catalyst, comprising 47 percent alumina as a support, contained 0.71 percent sodium. The catalyst surface area was 105.2 $m^2/g$ and its pore volume was 0.23 cc/g. An analysis of its particle size distribution showed that about 0.6 percent was less than 19 microns in size, 5.3 percent was between 19 and 38 microns, 50.6 percent was between 38 and 75 microns, and the remainder was larger than 75 microns.

Prior to use, the contaminant metal (nickel or vanadium) was impregnated on the catalyst by saturating the catalyst with nickel or vanadium naphthenate. Bismuth was then deposited on several samples of the catalyst by impregnation using triphenyl bismuth. Each catalyst sample was tested in a reactor at identical conditions. The catalytic cracking was initiated at a catalyst bed temperature of 960° F. The gas oil was fed to the reactor at a weight hourly space velocity of 16 $hr^{-1}$ providing a contact time of 80 seconds.

Example II 2000 ppm nickel was impregnated on equilibrium catalyst as described above. The reduction in conversion and gasoline yield, and increases in coke and hydrogen yield compared to the uncontaminated catalyst resulting from this contamination are shown in Table III. Also shown are the effects of adding 400, 1000, and 4000 ppm bismuth to catalyst to which 2000 ppm nickel had been added. Suppression of the deleterious effects is seen for all the cases involving bismuth addition; however, in accordance with the present invention, it is shown that a small amount of bismuth, namely 400 ppm in this case, provides preferred passivation effects, with the higher levels of bismuth proving to be less effective.

Example III

Example II was repeated except that in this case, 5000 ppm nickel was impregnated on the catalyst, and 1000, 2500, 5000, and 9000 ppm of bismuth respectively, were impregnated on various samples of equilibrium catalyst containing 5000 ppm nickel. The results are shown in Table IV.

Example IV

Example II was repeated except that the equilibrium catalyst was impregnated with 4000 to 10,000 ppm vanadium. Table V shows that the addition of small amounts of bismuth, 1000 ppm bismuth in the case of the catalyst contaminated with 4000 ppm vanadium, and 2500 ppm bismuth in the case of the catalyst contaminated with 10,000 ppm vanadium, is sufficient to suppress the poisoning effects of vanadium, and increase conversion.

Example V

In another embodiment of this invention, it is contemplated that a passivating agent that comprises of a mixture of bismuth and antimony can be employed to achieve effective passivation. To illustrate this embodiment, samples of the same equilibrium catalyst were impregnated with nickel alone, with nickel and antimony alone, with nickel and bismuth alone, and finally, with nickel, antimony and bismuth. Results of examples using 2000 ppm nickel, 1000 ppm antimony and 1000 ppm bismuth are presented in Table VI, while results of examples using 5000 ppm nickel, 2500 ppm antimony and 2500 ppm bismuth are presented in Table VII. The data in both Tables VI and VII indicate that the benefits achieved in coke and gas ($C_2$ and lighter) make reductions with the combined use of antimony and bismuth may even be greater than those achieved with either antimony or bismuth alone.

Example VI

In yet another embodiment of this invention, it is contemplated that a passivating agent that comprises of a mixture of bismuth and tin can be employed to achieve effective passivation. To illustrate this embodiment, samples of the same equilibrium catalyst were impregnated with vanadium alone, with vanadium and bismuth alone, with vanadium and tin alone, and with vanadium, bismuth and tin. Examples using 4000 ppm vanadium, 1000 ppm bismuth and 1000 ppm tin are shown in Table VIII. The data clearly indicate that the benefits achieved in coke and gas ($C_2$ and lighter) make reductions with the combined use of tin and bismuth may also be greater than those achieved with either tin or bismuth alone.

TABLE III

| Run No. | 2000 wppm Nickel and Varying Levels of Bismuth Added to Equilibrium Catalyst 1 | 2 | 3 | 4 | 5 |
|---|---|---|---|---|---|
| Vanadium, ppm | Equilibrium | — | — | — | — |
| Nickel, ppm | Catalyst | 2000 | 2000 | 2000 | 2000 |
| Bismuth, ppm | | — | 400 | 1000 | 4000 |
| Tin, ppm | | — | — | — | — |
| Antimony, ppm | | — | — | — | — |
| Conversion, vol % | 72.22 | 59.08 | 63.01 | 63.69 | 63.88 |
| Products Yields, vol % | | | | | |
| Total $C_3$'s | 6.84 | 3.94 | 4.46 | 4.64 | 5.35 |
| Propane | 1.45 | 0.29 | 0.40 | 0.45 | 0.86 |
| Propylene | 5.39 | 3.65 | 4.06 | 4.19 | 4.49 |
| Total $C_4$'s | 11.85 | 7.47 | 9.21 | 8.98 | 9.01 |
| I—Butane | 5.58 | 2.37 | 3.35 | 3.22 | 3.12 |
| N—Butane | 1.11 | 0.41 | 0.57 | 0.59 | 0.61 |
| Total Butenes | 5.16 | 4.69 | 5.30 | 5.17 | 5.29 |
| $C_5$-430° F. Gasoline | 59.23 | 45.07 | 52.99 | 50.28 | 48.58 |
| 430-650° F. LCGO | 18.55 | 25.21 | 23.36 | 23.40 | 20.60 |
| 650° F. + DO | 9.23 | 15.71 | 13.63 | 12.90 | 15.52 |
| $C_3$ + Liq. Rec. | 105.68 | 97.39 | 103.66 | 100.21 | 99.06 |
| FCC Gaso. + Alk. | 77.81 | 59.83 | 69.56 | 66.82 | 65.86 |
| Product Yields, wt % | | | | | |
| $C_2$ and Lighter | 1.55 | 2.31 | 2.05 | 2.22 | 2.16 |
| $H_2$ | 0.10 | 0.95 | 0.70 | 0.74 | 0.79 |
| Methane | 0.49 | — | — | — | 0.49 |
| Ethane | 0.47 | — | — | — | 0.41 |
| Ethylene | 0.49 | — | — | — | 0.49 |
| Carbon | 2.77 | 5.71 | 4.63 | 4.75 | 5.45 |

TABLE IV

| Run No. | 5000 wppm Nickel and Varying Levels of Bismuth Added to Equilibrium Catalyst 1 | 6 | 7 | 8 | 9 | 10 |
|---|---|---|---|---|---|---|
| Vanadium, ppm | Equilibrium | — | — | — | — | — |
| Nickel, ppm | Catalyst | 5000 | 5000 | 5000 | 5000 | 5000 |
| Bismuth, ppm | | — | 1000 | 2500 | 5000 | 9000 |
| Tin, ppm | | — | — | — | — | — |
| Antimony, ppm | | — | — | — | — | — |
| Conversion, vol % | 72.22 | 57.01 | 60.45 | 60.00 | 58.39 | 59.38 |
| Products Yields, vol % | | | | | | |
| Total $C_3$'s | 6.84 | 4.29 | 3.96 | 4.00 | 4.13 | 4.57 |
| Propane | 1.45 | 0.65 | 0.22 | 0.24 | 0.63 | 0.67 |
| Propylene | 5.39 | 3.64 | 3.74 | 3.76 | 3.50 | 3.89 |
| Total $C_4$'s | 11.85 | 6.67 | 8.03 | 7.97 | 6.79 | 7.53 |
| I—Butane | 5.58 | 2.07 | 2.57 | 2.43 | 2.31 | 2.40 |
| N—Butane | 1.11 | 0.38 | 0.42 | 0.43 | 0.38 | 0.44 |
| Total Butenes | 5.16 | 4.22 | 5.04 | 5.12 | 4.10 | 4.69 |
| $C_5$-430° F. Gasoline | 59.23 | 42.92 | 49.39 | 48.29 | 45.89 | 45.87 |
| 430-650° F. LCGO | 18.55 | 25.05 | 24.76 | 25.15 | 24.69 | 23.72 |
| 650° F. + DO | 9.23 | 17.94 | 14.79 | 14.85 | 16.93 | 16.90 |
| $C_3$ + Liq. Rec. | 105.68 | 96.86 | 100.93 | 100.26 | 98.42 | 98.59 |
| FCC Gaso. + Alk. | 77.81 | 56.81 | 64.92 | 64.01 | 59.32 | 61.04 |
| Product Yields, wt % | | | | | | |
| $C_2$ and Lighter | 1.55 | 2.27 | 2.33 | 2.41 | 1.97 | 2.11 |
| $H_2$ | 0.10 | 1.04 | 1.05 | 1.05 | 0.93 | 0.91 |
| Methane | 0.49 | 0.44 | — | — | 0.36 | 0.42 |
| Ethane | 0.47 | 0.36 | — | — | 0.31 | 0.36 |
| Ethylene | 0.49 | 0.42 | — | — | 0.37 | 0.43 |
| Carbon | 2.77 | 6.39 | 6.21 | 6.41 | 6.16 | 6.13 |

TABLE V

| Run No. | Effect of Bismuth Addition on Vanadium Poisoned Equilibrium Catalyst 1 | 11 | 12 | 13 | 14 |
|---|---|---|---|---|---|
| Vanadium, wppm | Equilibrium | 4000 | 4000 | 10000 | 10000 |
| Nickel, wppm | Catalyst | — | — | — | — |
| Bismuth, wppm | | — | 1000 | — | 2500 |
| Tin, wppm | | — | — | — | — |
| Antimony, wppm | | — | — | — | — |
| Conversion, vol % | 72.22 | 61.37 | 63.50 | 56.17 | 59.91 |
| Products Yields, vol % | | | | | |
| Total $C_3$'s | 6.84 | 4.90 | 5.78 | 4.15 | 3.92 |
| Propane | 1.45 | 0.99 | 1.17 | 0.77 | 0.72 |
| Propylene | 5.39 | 3.91 | 4.61 | 3.38 | 3.20 |

TABLE V-continued

| Effect of Bismuth Addition on Vanadium Poisoned Equilibrium Catalyst | | | | | |
|---|---|---|---|---|---|
| Run No. | 1 | 11 | 12 | 13 | 14 |
| Total $C_4$'s | 11.85 | 8.08 | 9.08 | 6.17 | 6.22 |
| I—Butane | 5.58 | 3.14 | 3.14 | 1.80 | 2.00 |
| N—Butane | 1.11 | 0.63 | 0.70 | 0.41 | 0.41 |
| Total Butenes | 5.16 | 4.31 | 5.23 | 3.96 | 3.81 |
| $C_5$-430° F. Gasoline | 59.23 | 50.49 | 48.55 | 41.96 | 45.07 |
| 430-650° F. LCGO | 18.55 | 24.15 | 22.34 | 25.47 | 21.68 |
| 650° F. + DO | 9.23 | 14.49 | 14.16 | 18.36 | 18.41 |
| $C_3$ + Liq. Rec. | 105.68 | 102.11 | 99.90 | 96.84 | 95.30 |
| FCC Gaso. + Alk. | 77.81 | 65.02 | 65.93 | 55.65 | 57.46 |
| Product Yields, wt % | | | | | |
| $C_2$ and Lighter | 1.55 | 1.93 | 2.45 | 2.44 | 2.16 |
| $H_2$ | 0.10 | 0.57 | 0.68 | 0.99 | 0.93 |
| Methane | 0.49 | 0.51 | 0.69 | 0.56 | 0.48 |
| Ethane | 0.47 | 0.46 | 0.58 | 0.48 | 0.40 |
| Ethylene | 0.49 | 0.39 | 0.50 | 0.41 | 0.34 |
| Carbon | 2.77 | 4.38 | 4.85 | 6.21 | 6.15 |

TABLE VI

| Comparison of the Addition of Bismuth Antimony, and Both Metals on 2000 wppm Added Nickel on Equilibrium Catalyst | | | | | |
|---|---|---|---|---|---|
| Run No. | 1 | 2 | 15 | 4 | 16 |
| Vanadium, wppm | Equilibrium | — | — | — | — |
| Nickel, wppm | Catalyst | 2000 | 2000 | 2000 | 2000 |
| Bismuth, wppm | | — | — | 1000 | 1000 |
| Tin, wppm | | — | — | — | — |
| Antimony, wppm | | — | 1000 | — | 1000 |
| Conversion, vol % | 72.22 | 59.08 | 61.99 | 63.69 | 64.01 |
| Products Yields, vol % | | | | | |
| Total $C_3$'s | 6.84 | 3.94 | 4.48 | 4.64 | 4.93 |
| Propane | 1.45 | 0.29 | 0.41 | 0.45 | 0.87 |
| Propylene | 5.39 | 3.65 | 4.07 | 4.19 | 4.06 |
| Total $C_4$'s | 11.85 | 7.47 | 9.01 | 8.98 | 8.34 |
| I—Butane | 5.58 | 2.37 | 3.09 | 3.22 | 3.33 |
| N—Butane | 1.11 | 0.41 | 0.53 | 0.59 | 0.58 |
| Total Butenes | 5.16 | 4.69 | 5.40 | 5.17 | 4.44 |
| $C_5$-430° F. Gasoline | 59.23 | 45.07 | 52.91 | 50.28 | 49.17 |
| 430-650° F. LCGO | 18.55 | 25.21 | 25.22 | 23.40 | 22.21 |
| 650° F. + DO | 9.23 | 15.71 | 12.80 | 12.90 | 13.78 |
| $C_3$ + Liq. Rec. | 105.68 | 97.39 | 104.41 | 100.21 | 98.43 |
| FCC Gaso. + Alk. | 77.81 | 59.83 | 69.66 | 66.82 | 64.18 |
| Product Yields, wt % | | | | | |
| $C_2$ and Lighter | 1.55 | 2.31 | 2.24 | 2.22 | 1.82 |
| $H_2$ | 0.10 | 0.95 | 0.84 | 0.74 | 0.64 |
| Methane | 0.49 | — | — | — | 0.39 |
| Ethane | 0.47 | — | — | — | 0.36 |
| Ethylene | 0.49 | — | — | — | 0.42 |
| Carbon | 2.77 | 5.71 | 5.11 | 4.75 | 4.71 |

TABLE VII

| Comparison of the Addition of Bismuth, Antimony, and Both Metals on 5000 wppm Added Nickel Equilibrium Catalyst | | | | | |
|---|---|---|---|---|---|
| Run No. | 1 | 6 | 17 | 8 | 18 |
| Vanadium, ppm | Equilibrium | — | — | — | — |
| Nickel, ppm | Catalyst | 5000 | 5000 | 5000 | 5000 |
| Bismuth, ppm | | — | — | 2500 | 2500 |
| Tin, ppm | | — | — | — | — |
| Antimony, ppm | | — | 2500 | — | 2500 |
| Conversion, vol % | 72.22 | 57.01 | 57.96 | 60.00 | 60.34 |
| Products Yields, vol % | | | | | |
| Total $C_3$'s | 6.84 | 4.29 | 3.72 | 4.00 | 4.63 |
| Propane | 1.45 | 0.65 | 0.20 | 0.24 | 0.70 |
| Propylene | 5.39 | 3.64 | 3.52 | 3.76 | 3.93 |
| Total $C_4$'s | 11.85 | 6.67 | 7.42 | 7.97 | 7.51 |
| I—Butane | 5.58 | 2.07 | 2.18 | 2.43 | 2.50 |
| N—Butane | 1.11 | 0.38 | 0.37 | 0.43 | 0.44 |
| Total Butenes | 5.16 | 4.22 | 4.87 | 5.12 | 4.57 |
| $C_5$-430° F. Gasoline | 59.23 | 42.92 | 46.12 | 48.29 | 47.37 |
| 430-650° F. LCGO | 18.55 | 25.05 | 25.40 | 25.15 | 23.72 |
| 650° F. + DO | 9.23 | 17.94 | 16.64 | 14.85 | 15.94 |
| $C_3$ + Liq. Rec. | 105.68 | 96.86 | 99.30 | 100.26 | 99.16 |

TABLE VII-continued

| Comparison of the Addition of Bismuth, Antimony, and Both Metals on 5000 wppm Added Nickel Equilibrium Catalyst | | | | | |
|---|---|---|---|---|---|
| Run No. | 1 | 6 | 17 | 8 | 18 |
| FCC Gaso. + Alk. | 77.81 | 56.81 | 60.96 | 64.01 | 62.38 |
| Product Yields, wt % | | | | | |
| $C_2$ and Lighter | 1.55 | 2.27 | 2.33 | 2.41 | 2.09 |
| $H_2$ | 0.10 | 1.04 | 1.05 | 1.05 | 0.87 |
| Methane | 0.49 | 0.44 | — | — | 0.42 |
| Ethane | 0.47 | 0.36 | — | — | 0.37 |
| Ethylene | 0.49 | 0.42 | — | — | 0.43 |
| Carbon | 2.77 | 6.39 | 6.54 | 6.41 | 5.60 |

TABLE VIII

| Effect of Bismuth and Tin Addition on Vanadium Poisoned Equilibrium Catalyst | | | | | |
|---|---|---|---|---|---|
| Run No. | 1 | 11 | 12 | 19 | 20 |
| Vanadium, ppm | Equilibrium | 4000 | 4000 | 4000 | 4000 |
| Nickel, ppm | Catalyst | — | — | — | — |
| Bismuth, ppm | | — | 1000 | — | 1000 |
| Tin, ppm | | — | — | 1000 | 1000 |
| Antimony, ppm | | — | — | — | — |
| Conversion, vol % | 72.22 | 61.37 | 63.50 | 62.86 | 62.98 |
| Products Yields, vol % | | | | | |
| Total $C_3$'s | 6.84 | 4.90 | 5.78 | 5.46 | 5.27 |
| Propane | 1.45 | 0.99 | 1.17 | 1.10 | 1.02 |
| Propylene | 5.39 | 3.91 | 4.61 | 4.36 | 4.25 |
| Total $C_4$'s | 11.85 | 8.08 | 9.08 | 8.85 | 8.68 |
| I—Butane | 5.58 | 3.14 | 3.14 | 3.21 | 3.29 |
| N—Butane | 1.11 | 0.63 | 0.70 | 0.68 | 0.66 |
| Total Butenes | 5.16 | 4.31 | 5.23 | 4.97 | 4.73 |
| $C_5$-430° F. Gasoline | 59.23 | 50.49 | 48.55 | 50.41 | 50.12 |
| 430-650° F. LCGO | 18.55 | 24.15 | 22.34 | 23.24 | 22.98 |
| 650° F. + DO | 9.23 | 14.49 | 14.16 | 13.89 | 14.04 |
| $C_3$ + Liq. Rec. | 105.68 | 102.11 | 99.90 | 101.86 | 101.10 |
| FCC Gaso. + Alk. | 77.81 | 65.02 | 65.93 | 66.88 | 65.99 |
| Product Yields, wt % | | | | | |
| $C_2$ and Lighter | 1.55 | 1.93 | 2.45 | 2.22 | 2.01 |
| $H_2$ | 0.10 | 0.57 | 0.68 | 0.61 | 0.58 |
| Methane | 0.49 | 0.51 | 0.69 | 0.59 | 0.54 |
| Ethane | 0.47 | 0.46 | 0.58 | 0.55 | 0.48 |
| Ethylene | 0.49 | 0.39 | 0.50 | 0.48 | 0.41 |
| Carbon | 2.77 | 4.38 | 4.85 | 4.44 | 4.34 |

What is claimed is:

1. In a process for the conversion of hydrocarbon oil feed which comprises contacting a hydrocarbon feed containing metal contaminants including nickel, vanadium and iron with a cracking catalyst in a fluid catalytic cracking system, the improvement comprising:

(a) analyzing the hydrocarbon feed for nickel equivalents (defined as [nickel+0.2 vanadium+0.1 iron]) and determining the quantity of nickel equivalents in said hydrocarbon feed, and (b) introducing a composition for mitigating or suppressing the contaminants-caused poisoning of the catalyst into said catalytic cracking system, said composition selected from the group consisting of bismuth, bismuth compounds and mixtures thereof, in a weight ratio of introduced bismuth composition to nickel equivalents of between about 0.01:1 and about 1:1.

2. The process of claim 1 in which said cracking catalyst is a zeolite-containing cracking catalyst.

3. The process of claim 2 wherein said added bismuth composition and said added nickel equivalents deposit on said catalyst in a weight ratio of bismuth composition to nickel equivalents of between about 0.01:1 and about 1:1.

4. The process of claim 1 wherein the said hydrocarbon feed contains at least about 1 ppm nickel equivalents.

5. The process of claim 1 wherein said circulating catalyst is removed at a rate of about 0.5 to about 10 percent of the total catalyst per day, and replaced with essentially fresh, non-contaminated catalyst.

6. The process of claim 1 in which said bismuth composition is an organic compound soluble in the hydrocarbon feed or capable of forming a colloidal suspension in the hydrocarbon feed.

7. The process of claim 1 in which said composition comprises bismuth and antimony compounds, bismuth and tin compounds, or bismuth, antimony and tin compounds.

8. The process of claims 1 or 7 in which the said bismuth composition, or bismuth, antimony and tin compounds are introduced separately from the feed into the fluid catalytic cracking system.

9. The process of claims 1 or 7 in which the said bismuth composition, or bismuth, antimony and tin compounds are introduced into the fluid catalytic cracking system concurrently with the hydrocarbon feed.

10. The process of claims 1 or 7 in which the said bismuth composition, or bismuth, antimony and tin compounds are deposited on essentially fresh cracking catalyst, and the resulting composition is introduced into the fluid catalytic cracking system.

11. The process of claims 1 or 7 in which the said bismuth composition, or bismuth, antimony and tin compounds are admixed with regenerated catalyst prior to the introduction thereof into the cracking zone.

12. The process of claims 1 or 7 in which said bismuth composition, or bismuth, antimony and tin compounds are deposited on separate, non-zeolite containing particles and introduced into the fluid catalytic cracking system.

13. The process of claims 1 or 7 in which said bismuth composition, or bismuth, antimony and tin compounds are introduced into the cracking process on used catalyst fines, said used catalyst fines having been removed from a hydrocarbon cracking process in which said compositions or compounds have been used to mitigate detrimental effects of metals on this hydrocarbon cracking process.

14. The process of claims 1 or 7 in which said bismuth composition, or bismuth, antimony and tin compounds are introduced into the regeneration zone of the fluid catalytic cracking system as solids, in admixture with fresh make-up catalyst.

15. In a process for the conversion of hydrocarbon oil feed which comprises contacting a hydrocarbon feed containing metal contaminants including nickel, vanadium and iron with a cracking catalyst in a fluid catalytic cracking system, the improvement comprising:

(a) analyzing the cracking catalyst for a nickel equivalent (defined as [nickel+0.2 vanadium+0.1 iron]) and determining the quantity of nickel equivalents on said catalyst, and (b) introducing a composition for mitigating or suppressing the contaminants causing poisoning of the caalyst into said catalytic cracking system, said composition selected from the group consisting of bismuth, bismuth compounds and mixtures thereof, in a weight ratio of introduced bismuth composition to nickel equivalents of between about 0.01:1 and about 1:1.

16. The process of claim 15 in which said cracking catalyst is a zeolite-containing cracking catalyst.

17. The process of claim 16 wherein said added bismuth composition and said added nickel equivalents deposit on said catalyst in a weight ratio of bismuth composition to nickel equivalents of between about 0.01:1 and about 1:1.

18. The process of claim 15 wherein the said hydrocarbon feed contains at least about 1 ppm nickel equivalents.

19. The process of claim 15 wherein said circulating catalyst is removed at a rate of about 0.5 to about 10 percent of the total catalyst per day, and replaced with essentially fresh, non-contaminated catalyst.

20. The process of claim 15 in which said bismuth composition is an organic compound soluble in the hydrocarbon feed or capable of forming a colloidal suspension in the hydrocarbon feed.

21. The process of claim 15 in which said composition comprises bismuth and antimony compounds, bismuth and tin compounds, or bismuth, antimony and tin compounds.

22. The process of claim 15 or 21 in which the said bismuth composition, or bismuth, antimony and tin compounds are introduced separately from the feed into the fluid catalytic cracking system.

23. The process of claim 15 or 21 in which the said bismuth composition, or bismuth, antimony and tin compounds are introduced into the fluid catalytic cracking system concurrently with the hydrocarbon feed.

24. The process of claim 15 or 21 in which the said bismuth composition, or bismuth, antimony and tin compounds are deposited on essentially fresh cracking catalyst, and the resulting composition is introduced into the fluid catalytic cracking system.

25. The process of claim 15 or 21 in which the said bismuth composition, or bismuth, antimony and tin compounds are admixed with regenerated catalyst prior to the introduction thereof into the cracking zone.

26. The process of claim 15 or 21 in which said bismuth composition, or bismuth, antimony and tin compounds are deposited on separate, non-zeolite containing particles and introduced into the fluid catalytic cracking system.

27. The process of claim 15 or 21 in which said bismuth composition, or bismuth, antimony and tin compounds are introduced into the cracking process on used catalyst fines, said used catalyst fines having been removed from a hydrocarbon cracking process in which said compositions or compounds have been used to mitigate detrimental effects of metals on this hydrocarbon cracking process.

28. The process of claim 15 or 21 in which said bismuth composition, or bismuth, antimony and tin compounds are introduced into the regeneration zone of the fluid catalytic cracking system as solids, in admixture with fresh make-up catalyst.

* * * * *